United States Patent [19]

Flatz et al.

[11] Patent Number: 4,691,082

[45] Date of Patent: Sep. 1, 1987

[54] PLASTIC CABLE

[75] Inventors: Josef Flatz, Waldmichelbach; Gert Weddigen, Heidelberg; Hans-Joachim Böhme, Ketzsch; Fritz Grieser, Weinheim; Robert Huber, Ketsch; Hans Nienburg, Mainz, all of Fed. Rep. of Germany

[73] Assignee: Brown, Boveri & Cie AG, Mannheim-Käfertal, Fed. Rep. of Germany

[21] Appl. No.: 839,070

[22] Filed: Mar. 13, 1986

[30] Foreign Application Priority Data

Mar. 14, 1985 [DE] Fed. Rep. of Germany ..... 3509168

[51] Int. Cl.[4] ..... H01B 9/02

[52] U.S. Cl. ..... 174/106 SC; 174/106 R; 252/500

[58] Field of Search ..... 174/106 R, 106 SC, 102 SC; 252/500, 519

[56] References Cited

U.S. PATENT DOCUMENTS

| | | | |
|---|---|---|---|
| 3,878,319 | 4/1975 | Wahl | 174/106 SC |
| 4,342,880 | 8/1982 | Castelli et al. | 174/106 SC X |
| 4,417,093 | 11/1983 | Occhini et al. | 174/102 SC |
| 4,419,277 | 12/1983 | Myers | 252/500 |
| 4,440,669 | 4/1984 | Ivory et al. | 528/488 X |
| 4,452,727 | 6/1984 | Frommer et al. | 252/500 X |
| 4,486,721 | 12/1984 | Cornelius et al. | 174/106 R X |
| 4,487,996 | 12/1984 | Rabinowitz et al. | 174/106 SC X |
| 4,510,076 | 4/1985 | Lee et al. | 524/80 X |
| 4,548,737 | 10/1985 | Ballard et al. | 252/518 X |

OTHER PUBLICATIONS

"New Plastics That Carry Electricity", Newsweek, Jun. 18, 1979, pp. 77–77A.

Epstein, Arthur J. and Miller, Joel S., "Linear-Chain Conductors", Scientific American, Oct. 1979, pp. 52–61.

*Primary Examiner*—Morris H. Nimmo

*Attorney, Agent, or Firm*—Herbert L. Lerner; Laurence A. Greenberg

[57] ABSTRACT

Plastic cable with at least one electric conductor which is surrounded by a cable covering which, besides an insulating layer comprises several electrically conducting layers of a polymer material. At least one electrically conducting layer is made of a polymer, a mixed polymerizate or a polymer alloy which is meltable and/or soluble, and the electric conductivity of which can be adjusted to a defined value by a content of charge transfer complexes.

19 Claims, 1 Drawing Figure

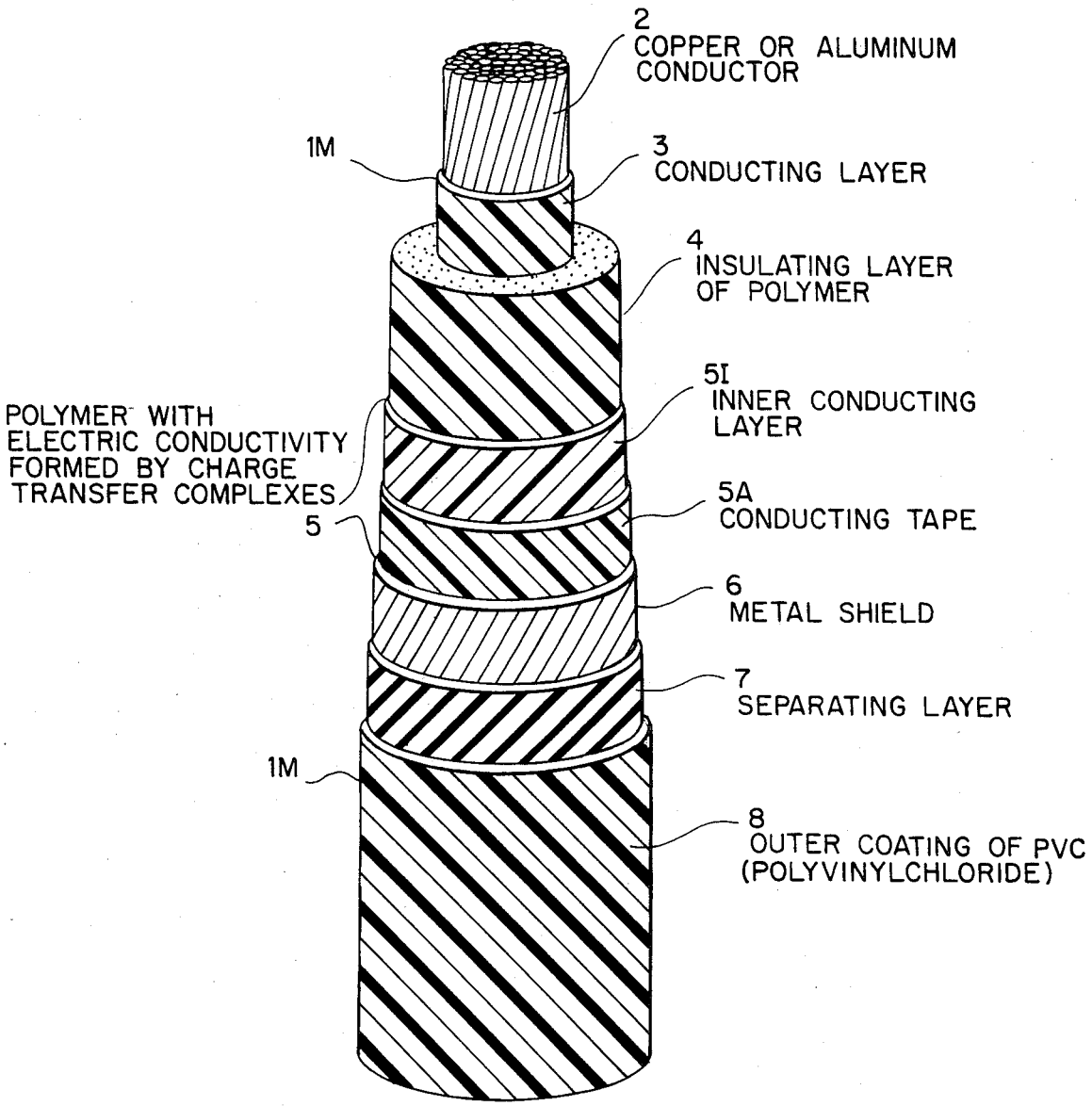
2
COPPER OR ALUMINUM CONDUCTOR
1M
3
CONDUCTING LAYER
4
INSULATING LAYER OF POLYMER
5I
INNER CONDUCTING LAYER
POLYMER WITH ELECTRIC CONDUCTIVITY FORMED BY CHARGE TRANSFER COMPLEXES
5
5A
CONDUCTING TAPE
6
METAL SHIELD
7
SEPARATING LAYER
1M
8
OUTER COATING OF PVC (POLYVINYLCHLORIDE)

PLASTIC CABLE

BACKGROUND OF THE INVENTION

1. Field of the Invention

The invention relates to a plastic cable with at least one electric conductor which is surrounded by a cable covering which includes in addition to at least one insulating layer, several electrically conducting layers of a polymer material.

2. Description of the Prior Art

Plastic cables of the above type are preferably used in electric power systems with rated voltages of 20 to more than 100 kV. The multi-layer conductor covering of these plastic cables, besides the insulation layer proper, also includes conductive layers or tapes. They are provided for smoothing out the contours of the metallic conductors used in the cable and to generate a radially homogeneous electric field in the insulation.

In the presently known plastic cables, the conductive layers are made of filled polyolefins which are extruded concurrently with the insulation in the same operation. The conductivity of these polyolefins is brought about by fillers such as carbon black and graphite. Polymer material with these additives has the disadvantage that with a small content of these fillers, the conductivity is not significantly increased and that with the addition of a certain amount of additives on, the conductivity then increases in step-fashion in such a manner that a defined conductivity of the plastics cannot be set reliably in the range of interest. Also, even with the finest possible grain of the fillers, field-distorting inhomogeneities can occur which lead to a reduction of the dielectric strength of the cable.

SUMMARY OF THE INVENTION

It is therefore an object of the invention to provide a plastic cable, in which the electrically conducting layers consist of a polymer material which can be adjusted to a defined electric conductivity and the homogeneity of which guarantees a fault-free transition between the insulating layer and the conducting layer.

With the foregoing and other objects in view, there is provided in accordance with the invention a plastic cable comprising at least one electric conductor surrounded by a cable covering comprising an insulating layer and a plurality of electrically conducting layers of a polymeric material, with at least one electrically conducting layer made of a polymer material selected from the group consisting of a polymer, a mixed polymerisate or a polymer alloy, said material having at least one of two properties (1) meltable-transformation from a solid into a liquid by means of heat, and (2) soluble-capable of mixing with a liquid to dissolve to form a solution, and the electric conductivity of which can be adjusted to a defined value by a content of charge transfer complexes.

Other features which are considered as characteristic for the invention are set forth in the appended claims.

Although the invention is illustrated and described herein as embodied in a plastic cable, it is nevertheless not intended to be limited to the details shown, since various modifications may be made therein without departing from the spirit of the invention and within the scope and range of equivalents of the claims.

BRIEF DESCRIPTION OF THE DRAWING

The invention, however, together with additional objects and advantages thereof will be best understood from the following description when read in connection with the accompanying drawing in which is illustrated a plastic cable partially cut away to show a central conductor of copper or aluminum 2 surrounded by a multi-layer cable covering 1M made up of an inner conducting layer 3, followed by an insulating layer 4 of polymer such as polyethylene, which latter layer is covered by an outer conducting layer 5 composed of an conducting layer 5I and a conducting tape 5A. The outer conducting layer contains a polymer or polymer alloy with electric conductivity formed by charge transfer complexes. The outer conducting layer is, in turn, covered by a metal shield 6 of copper wires or tapes, a separating layer 7, and an outer coating 8.

DESCRIPTION OF THE PREFERRED EMBODIMENTS

According to the invention, this problem in plastic cables of defined electric conductivity and field-distorting inhomogeneities is solved by the provision that at least one electrically conducting layer is made of a polymer, a mixed polymerisate or a polymer alloy which is meltable and/or soluble and the electric conductivity of which can be adjusted by a content of charge transfer complexes to a defined value.

The invention will be explained in the following in greater detail, making reference to an embodiment example:

The plastic cable shown in the drawing has a copper aluminum conductor 2 which is surrounded by an inner conducting layer 3. This is followed toward the outside by an insulating layer 4 of a polymer. The latter can, preferably, consist of polyethylene or a cross-linked polyethylene. This is followed by an outer conducting layer 5. In the case of the example, the latter is formed by an conducting layer 5I which is surrounded by a conducting tape 5A. Adjacent to this is a metal shield 6 of copper wires or tapes. A separating layer 7 is arranged between this metal shield 6 and the outer jacket 8 made of PVC (polyvinylchloride).

According to the invention, the conducting layer 5I and, if desired, including the tape 5A, is made of a polymer or a polymer alloy, the electric conductivity of which is formed by charge transfer complexes. The electric conductivity of the polymer material used can be adjusted readily and reliably to a defined value. For safety reasons, a conductivity of at least $10^{-5}$ $ohm^{-1}$ $cm^{-1}$ and, in particular, a conductivity in the range of $10^{-3}$ to $10^{-1}$ $ohm^{-1}$ $cm^{-1}$ is of advantage. Higher conductivities can be realized but are neither electrically required nor economically advantageous. The polymer materials according to the invention furthermore permit the preparation of especially smooth boundary surfaces since they contain no fillers and have a very homogeneous structure. The layer thickness of the electrically conducting layers is preferably 0.2 to 2 mm, desirably 0.3 to 1 mm.

The formation of the charge transfer complexes is caused by the addition of electron acceptors and/or donors. A triaromatic methane polymer is preferably used as a conductive polymer. The conductive polymer can also be used in the form of a mixed polymerisate or a polymer alloy which is accordingly formed by at least one insulating polymer and at least one conductive polymer. The polymers or polymer alloys used should be meltable or soluble so that they can be processed accordingly.

The conductive polymer contained in the electrically conducting layers 3 and 5 is formed, for instance, in the polycondensation of an aromatic aldehyde and an aromatic ring compound which comprises at least one functional group which increases the electron density in the aromatic ring compound and thereby promotes the electrophilic action. This polymer can be formed, for instance, by polycondensation of bisphenol-A and 4-dimethylaminobenzaldehyde. The synthetic polymer with triaromatic methane units as the basic building blocks can also be prepared by polycondensation of bisphenol-A and paraanis aldehyde. The polymer can also be obtained in a catalytic reaction, in which methanes substituted by double- or triple aromatics are brought to reaction. The electric conductivity of this polymer is brought about by the formation of charge transfer complexes. For this purpose, electron acceptors and/or donors are admixed to the polymer during the preparation or later in the dissolved or melted state. Particularly well suited as electron acceptors are iodine, sulfur trioxide, sulfuric acid and iron chloride. As an electron donor, sodium is suitable. The electric conductivity of this polymer can also be obtained by the addition of a mineral acid or a Lewis acid. The polymer can be dissolved in acetone or methylether ketone. At least one of the electrically conducting layers can be made of a soluble polymer material and applied in the form of a varnish or a paste.

According to the invention, the conducting layers 3 and 5 of the cable can also be produced from a conductive polymer alloy. The polymer alloy can also be prepared from a polar or non-polar insulating polymer and a polar or non-polar conducting polymer. Polar insulating polymers which can be used in particular for forming the polymer alloy are polyvinylchloride, polyesters (preferably polybutylene terephthalate), an epoxy resin compound, polycarbonate, a polyurethane resin compound or polyamide. Suitable as insulating polymers are polyethylene and its copolymers, polybutadiene, polystyrene, butadienestyrene or acrylonitrile butadiene-styrene copolymers. The conductive component of the polymer alloy is preferably formed by polar polymers on the basis of triaromatic methane which are doped with electron donors and/or electron acceptors. Suitable for this purpose are the electron donors and acceptors which were given above for the formation of the conductive polymer. Examples of non-polar conductive component which can be used are copolymers of acetylene and/or acetylene derivatives which are doped with electron donors and/or electron acceptors for forming charge transfer complexes.

For foils of a conductive polymer alloy which contain polyvinylchloride as the insulating polymer, the preparation of a small amount of this material is described in the following. To this end, 100 g polyvinylchloride in granulate form are mixed with 30 g of a softener, for instance, of diisodecylphthalate (DIDP) with 10 g triaromatic methane polymer in powder form. This triaromatic methane polymer forms the conductive component and is doped accordingly. The mixture formed in this manner is subsequently pressed for 20 minutes at 150° C. to form a foil. In the case of the embodiment example, the doping of the triaromatic methane polymer is proportioned so that the electric conductivity of the completed foil which can be used for the layer 5A is $10^{-3}(\text{ohm}\times\text{cm})^{-1}$ at room temperature.

The materials used for the development of the electrically conducting layers 3 and 5 can preferably also be made of a polymer alloy which is prepared using an ethylvinyl acetatepolyethylene polymer and a doped triaromatic methane polymer. For preparing a sample amount, 1000 g of the ethylvinylacetate polyethylene copolymer in the form of a granulate are mixed at room temperature with 20% by weight of a triaromatic methane polymer. The triaromatic methane polymer is doped appropriately for achieving a defined electric conductivity. The mixture so formed is suitable for co-extrusion with a normal polyethylene insulating layer. The conductivity of the triaromatic methane polymer is proportioned so that the electric conductivity of the layer is $3\times10^{-3}\,(\text{ohm}\times\text{cm})^{-1}$ at room temperature.

The conductive polymer alloy or the conductive polymer according to the invention which is used for the preparation of the conducting layers 3 and 5 is readily processed material which, with the insulating materials used, makes possible the formation of a durable composite free of voids. The electrically conducting layers 3 and 5 made of the polymer or the polymer alloy exhibit properties not only with respect to electrical but also with respect to mechanical and thermal properties, which make the intended use in the manufacture of the cables appear advantageous.

The invention is not limited to the embodiment shown in the drawing. Rather, cables with more than one conductor and the corresponding enclosures can also be manufactured by it. In particular, a single-layer construction of the outer conducting layer, omitting the wrapping 5A, may be employed, or a combination with a conventional carbon black paper or woven tape or the like as the wrapping, which is advantageous from a thermal point of view.

There is claimed:

1. Plastic cable comprising at least one electric conductor surrounded by a cable covering comprising an insulating layer and a plurality of electrically conducting layers of a polymeric material which include an inner conducting layer and an outer conducting layer, with at least the outer conducting layer made of a synthetic polymer of triaromatic methane units, said synthetic polymer formed by polycondensation of an aromatic aldehyde and an aromatic ring compound which has at least one functional group which increases the electric density in the aromatic ring compound and thereby promotes the electrophilic action; by polycondensation of bisphenol-A and 4-dimethylaminobenzaldehyde; by polycondensation of bisphenol-A and para-anisaldehyde; and by a catalytic reaction in which methanes substituted by double-or triple aromatics are brought to reaction, said polymer having at least the properties, (1) meltable-transformation from a solid into a liquid by means of heat, and (2) soluble-capable of mixing with a liquid to dissolve to form a solution, the electric conductivity of the layers of polymer with triaromatic methane units is adjusted to at least $10^{-5}\,\text{ohm}^{-1}\,\text{cm}^{-1}$ by a content of charge transfer complexes, and the outer conducting layer is composed of an extruded layer of the conductive meltable polymer with triaromatic units and of a wrapping disposed thereon of carbon-black-containing paper or woven tape.

2. Plastic cable according to claim 1, wherein the polymer is based on overlapping triaromatic methane units.

3. Plastic cable according to claim 1, wherein the polymer is based on non-overlapping triaromatic methane units.

4. Plastic cable according to claim 1, wherein an electron acceptor for forming charge transfer complexes selected from the group consisting of iodine, sulfur trioxide, sulfuric acid or iron chloride is admixed to the polymer.

5. Plastic cable according to claim 1, wherein an alkali metal is admixed to the polymer as an electron donor for forming charge transfer complexes.

6. Plastic cable according to claim 1, wherein sodium is admixed to the polymer as an electron donor for forming charge transfer complexes.

7. Plastic cable according to claim 1, wherein an acid selected from the group consisting of a mineral acid or a Lewis acid is admixed to the polymer for adjusting to a defined electric conductivity.

8. Plastic cable according to claim 1, wherein the inner conducting layer is applied directly to the electric conductor, and the outer conducting layer is applied directly to the insulating layer.

9. Plastic cable according to claim 8, wherein the polymer materials to be applied as inner and outer conducting layers are meltable and, together with the insulating layer is applied to the electric conductor as the inner and outer conducting layers by co-extrusion.

10. Plastic cable according to claim 1, wherein at least one of the electrically conducting layers is made of polymer and is applied in the form of a varnish or a paste.

11. Plastic cable according to claim 8, wherein the layer thickness of the electrically conducting layers is 0.2 to 2 mm.

12. Plastic cable according to claim 8, wherein the layer thickness of the electrically conducting layers is 0.3 to 1 mm.

13. Plastic cable comprising at least one electric conductor surrounded by a cable covering comprising an insulating layer and a plurality of electrically conducting layers of a polymeric material which includes an inner conducting layer and an outer conducting layer, with at least the outer conducting layer made of a polymer alloy made of a polymer of triaromatic methane units and an another polymer said synthetic polymer formed by polycondensation of an aromatic aldehyde and an aromatic ring compound which has at least one functional group which increases the electric density in the aromatic ring compound and thereby promotes the electrophilic action; by polycondensation of bisphenol-A and 4-dimethylaminobenzaldehyde; by polycondensation of bisphenol-A and para-anisaldehyde; and by a catalytic reaction in which methanes substituted by double-or triple aromatics are brought to reaction, said polymer having at least the properties (1) meltable-transformation from a solid into a liquid by means of heat, and (2) soluble-capable of mixing with a liquid to dissolve to form a solution, the electric conductivity of the polymer alloy layers is adjusted to at least $10^{-5}$ $ohm^{-1}$ $cm^{-1}$ by a content of charge transfer complexes in the polymer of triaromatic methane units in the polymer alloy and that the outer conducting layer is composed of an extruded layer of the conductive meltable polymer alloy, and of a wrapping disposed thereon of carbon-black-containing paper or woven tape.

14. Plastic cable according to claim 13, wherein the polymer alloy used for the formation of the conducting layers is formed at least of an insulating polymer and a conduction polymer, and the polymer alloy has a homogeneous distribution of the two polymers.

15. Plastic cable according to claim 14, wherein the insulating polymer is selected from the group consisting of a polar or non-polar insulating polymer and conducting polymer is selected from the group consisting of a polar or non-polar conductive polymer.

16. Plastic cable according to claim 15, wherein the polymer alloy contains as the polar insulating polymer a member of the group consisting of polyvinyl chloride, a polyester, a nitrile rubber, an epoxy resin compound, polycarbonate, a polyurethane resin compound or a polyamide.

17. Plastic cable according to claim 15, wherein the polymer alloy contains as the non-polar insulating polymer a member selected from the group consisting of polyethylene, polybutadiene, polystyrene or butadiene styrene copolymers.

18. Plastic cable according to claim 15, wherein the polymer alloy contains as the polar insulating polymer a member selected from the group consisting of polyethylene copolymerisate, especially ehtylvinyl acetate-polyethylene copolymer or acrylonitrile butadiene-styrene copolymer.

19. Plastic cable comprising of at least one electric conductor surrounded by a cable covering comprising an insulating layer and a plurality of electrically conducting layers of a polymeric material which includes an inner conducting layer and an outer conducting layer, with at least the outer conducting layer made of a polymer alloy made of conductive non-polar copolymers of acetylene and their acetylene derivatives and an insulating polymer, and the polymer alloy has a homogeneous distribution of the two polymer components, said polymer having at least the properties (1) meltable-transformation from a solid into a liquid by means of heat, and (2) an electric conductivity of the polymer alloy layers adjusted to at least $10^{-5}$ $ohm^{-1}$ $cm^{-1}$ by a content of charge transfer complexes, and that the outer conducting layer is composed of an extruded layer of the conductive meltable polymer alloy, and of a wrapping disposed thereon of carbon-black-containing paper or woven tape.

* * * * *